US005435251A

United States Patent [19]

Clark et al.

[11] Patent Number: 5,435,251

[45] Date of Patent: Jul. 25, 1995

[54] APPLICATOR FOR APPLYING CHEMICALLY-IMPREGNATED PADS TO FRESHLY-MILLED SURFACES ON RAILROAD TIES, AND METHOD OF OPERATING SAME

[75] Inventors: Daniel C. Clark, Aurora; Edwin G. Pierrot, Holland, both of N.Y.

[73] Assignee: Eastern Railway Supplies, Inc., West Seneca, N.Y.

[21] Appl. No.: 162,535

[22] Filed: Dec. 3, 1993

[51] Int. Cl.[6] ..... E01B 29/00

[52] U.S. Cl. ..... 104/16

[58] Field of Search ..... 104/16, 2, 17.2, 17.1

[56] References Cited

U.S. PATENT DOCUMENTS

| | | | |
|---|---|---|---|
| 3,943,858 | 3/1976 | Dieringer et al. | 104/16 |
| 4,241,663 | 12/1980 | Lund et al. | 104/16 |
| 4,256,040 | 3/1981 | Dieringer | 104/17.1 |
| 4,691,639 | 9/1987 | Holley | 104/16 |
| 4,942,822 | 7/1990 | Cotic | 104/16 |
| 5,067,412 | 11/1991 | Theurer et al. | 104/16 |
| 5,331,899 | 7/1994 | Holley | 104/16 |

*Primary Examiner*—Mark T. Le

*Attorney, Agent, or Firm*—Phillips, Lytle, Hitchcock, Blaine & Huber

[57] ABSTRACT

An applicator adapted to apply chemically-impregnated pads (53) to freshly-milled surfaces (24) on railroad ties (22), includes a vehicle (21) adapted to be moved along the ties; a carriage (29) mounted for horizontal movement with the vehicle along the ties, and mounted for floating vertical movement relative to the vehicle during use; sensors (51,52) for determining the position of a tie beneath the carriage; a pad storage magazine (33) mounted on said carriage; suction cups (38) and an actuator (47) for withdrawing an end pad from the magazine; a rotary motor and a lifting actuator (36) for moving a withdrawn pad from the magazine to a freshly-milled surface on a tie; and a nailer (39) for attaching the pad to the tie.

18 Claims, 3 Drawing Sheets

APPLICATOR FOR APPLYING CHEMICALLY-IMPREGNATED PADS TO FRESHLY-MILLED SURFACES ON RAILROAD TIES, AND METHOD OF OPERATING SAME

TECHNICAL FIELD

The present invention relates generally to the field of railway maintenance and repair equipment, and, more particularly, to an improved device for automatically applying chemically-impregnated pads to freshly-milled surfaces on railroad ties, and to the method of operating same.

BACKGROUND ART

Railroads routinely level and replace rails as part of their ongoing track maintenance and repair.

In doing this, a rail is first removed. Then, portions of the ties on which the removed rail had rested are milled to desired heights so as to have the milled surfaces lying substantially in a common plane. After this, a rail is remounted on the milled surfaces of the ties.

Heretofore, wooden ties have been coated with various preservatives. The freshly-milled surfaces, commonly provided by an adzing operation, may expose untreated portions of the wood to the elements. Thus, to maintain the ties through their intended service lives, it is necessary to chemically treat the wooden surfaces exposed by the milling operation before the rail is remounted. However, because of various EPA and/or OSHA regulations, it is no longer permissible to simply spray the exposed surfaces with chemicals. Rather, chemically-impregnated pads are first placed on the exposed tie surfaces before the rail is re-applied. In time, the chemicals in these pads will leach into the wood.

The present invention is concerned with the automatic application and attachment of such pads to such freshly-milled tie surfaces. Manual application is impractical, and the work is repetitious and highly monotonous.

DISCLOSURE OF THE INVENTION

With parenthetical reference to the corresponding parts, portions or surfaces of the disclosed embodiment, merely for purposes of illustration and not by way of limitation, the present invention provides an improved applicator (20) for applying chemically-impregnated pads (53) to freshly-milled surfaces (24) on wooden railroad ties (22) passing therebeneath. The improved applicator broadly includes: a vehicle (21) adapted to be moved horizontally along the ties at a relative velocity; a carriage (29) mounted for horizontal movement with the vehicle along the ties, and mounted for upward and downward floating movement relative to the vehicle; sensor means (51,52) for sensing the position of each tie passing beneath the carriage; a pad storage magazine (33) mounted on said carriage; pad handling means (38) for withdrawing an end pad from the magazine; positioning means (36) for moving a withdrawn pad from the magazine to a freshly-milled surface on a sensed tie beneath the carriage; and nailing means (39) for attaching the withdrawn pad to the sensed tie.

In another aspect, the invention provides an improved method of applying chemically-impregnated pads (53) to freshly-milled surfaces (24) on railroad ties (22). The improved method includes the steps of: providing a vehicle capable of horizontal movement at a velocity relative to the ties; providing a carriage (29) on the vehicle for horizontal movement therewith and for upward and downward movement relative thereto, the carriage having a magazine (33) for the pads; sensing the position of each tie passing beneath the carriage; moving the vehicle horizontally relative to a tie at a velocity; withdrawing an end pad from the pad storage magazine; moving such withdrawn pad to a position aligned with the freshly-milled surface of a tie passing therebeneath; lowering the pad to engage the tie surface; and nailing the pad to the tie.

Accordingly, the general object of the invention is to provide an improved apparatus for automatically applying chemically-impregnated pads to freshly-milled surfaces on railroad ties.

Another object is to provide such a pad applicator in which the pad is first placed in the proper position on such freshly-milled surface, and is then secured to the tie, as by stapling, to prevent unintended separation.

Still another object is to provide an improved method of operating an automatic pad applicator.

These and other objects and advantages will become apparent from the foregoing and ongoing written specification, the drawings, and the appended claims.

DESCRIPTION OF THE PREFERRED EMBODIMENTS

Figure 2:
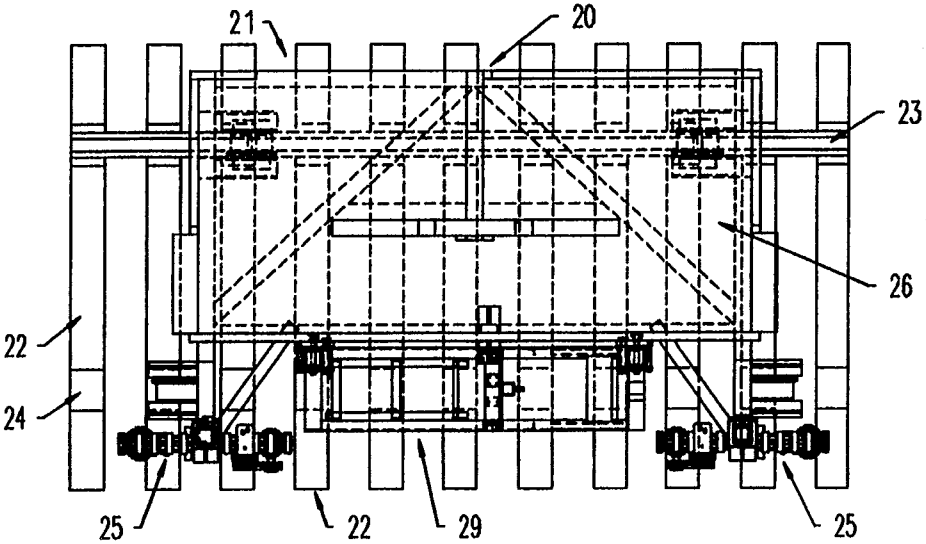
FIG. 2 is a top plan view of the vehicle and track section shown in FIG. 1.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 3:
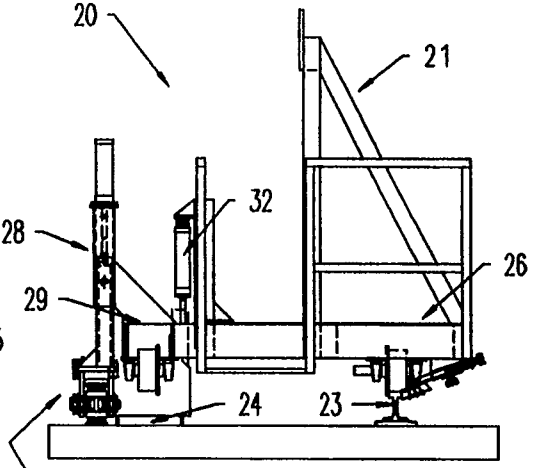
FIG. 3 is a rear elevational view of the vehicle shown in FIG. 1.
Figure 1:
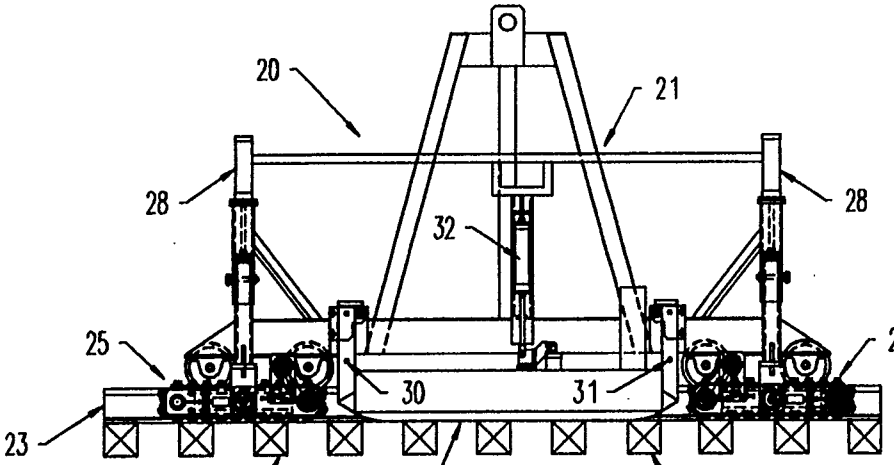
FIG. 1 is a left side elevational view of the vehicle arranged to move along a section of track, and showing the carriage as floating above the freshly-milled surfaces in the ties as the vehicle is moved along a track section.

Referring now to the drawings, and, more particularly, to FIGS. 1-3 thereof, the present invention broadly provides an improved applicator, generally indicated at 20, which is adapted to apply chemically-impregnated rectangular sheet-like pads to freshly-milled surfaces on railroad ties.

In FIGS. 1-3, the applicator is shown as including a vehicle, generally indicated at 21, which is adapted to be moved along a section of track from which one rail has been removed. This track section is shown as having a plurality of horizontally-spaced ties, severally indicated at 22, with the right rail 23 mounted thereon. The left rail has been removed from the track section in contemplation of the adzing operation. Thus, the ties are shown as having freshly-milled surfaces, severally indicated at 24, to which the chemically-impregnated pads are to be applied.

The vehicle is shown as having a pair of horizontally-spaced wheels which are adapted to ride on right rail 23. The left side of the vehicle is supported by a pair of horizontally-spaced motorized crawlers, severally indicated at 25, which are adapted to engage the upper surfaces of the ties. The motors (not shown) in crawlers 25 may be suitably operated to propel the vehicle along a section of track. Additional details as to the motive power for driving the crawlers have been omitted in the interest of clarity. The vehicle is shown as having a platform-like floor 26. A pair of vertical actuators, severally indicated at 28, are operatively engaged with the left side of the vehicle and the front and rear crawlers, and are used to level the floor.

A sled-like carriage, generally indicated at 29, is mounted on the vehicle for horizontal translational movement therewith along the track section, and for vertical movement relative thereto. To this end, the carriage has two longitudinally-spaced posts 30,31 extending vertically upwardly from either end. As shown in FIG. 1, these posts are received in suitable guides mounted on the vehicle. A lifting cylinder 32 acts between the vehicle and the carriage, and may be used to selectively lift and lower the carriage relative to the vehicle. When the carriage is lowered to its operative position, as shown in the various drawing figures, the opposite chambers of lifting cylinder 32 communicate with one another to allow the carriage to slidably engage the freshly-milled surfaces on the ties, as the vehicle is moved along the track section, and to float vertically relative to the vehicle.

Figure 4:
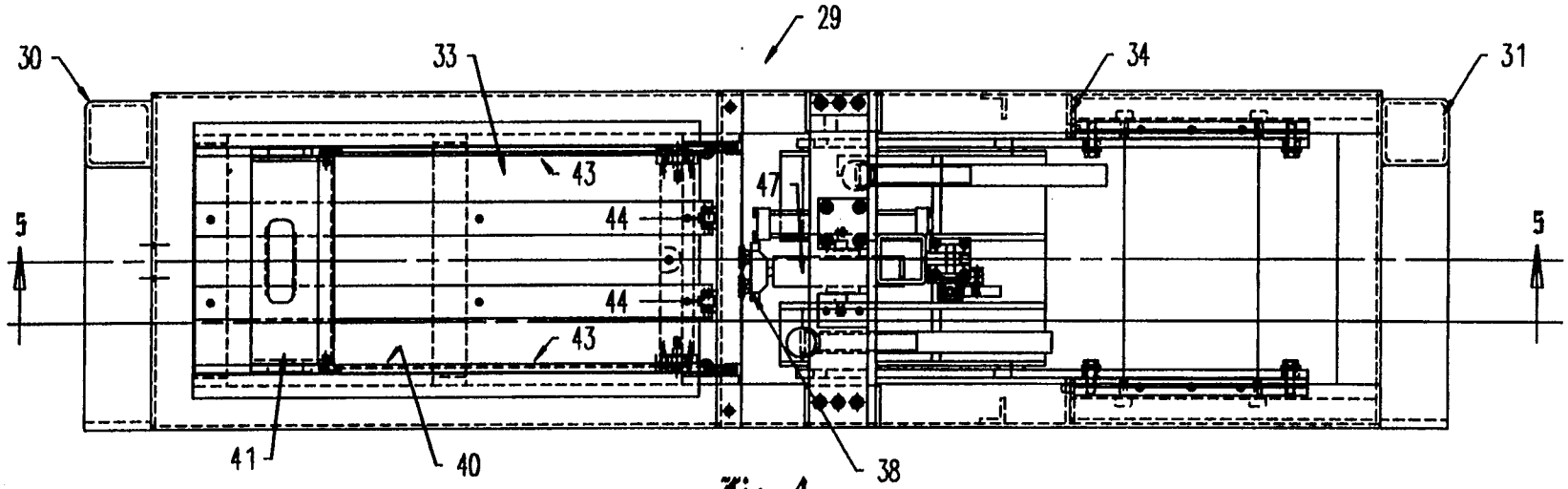
FIG. 4 is a top plan view of the carriage shown in FIG. 1, this view showing the empty pad storage magazine and the suction means.
Figure 5:
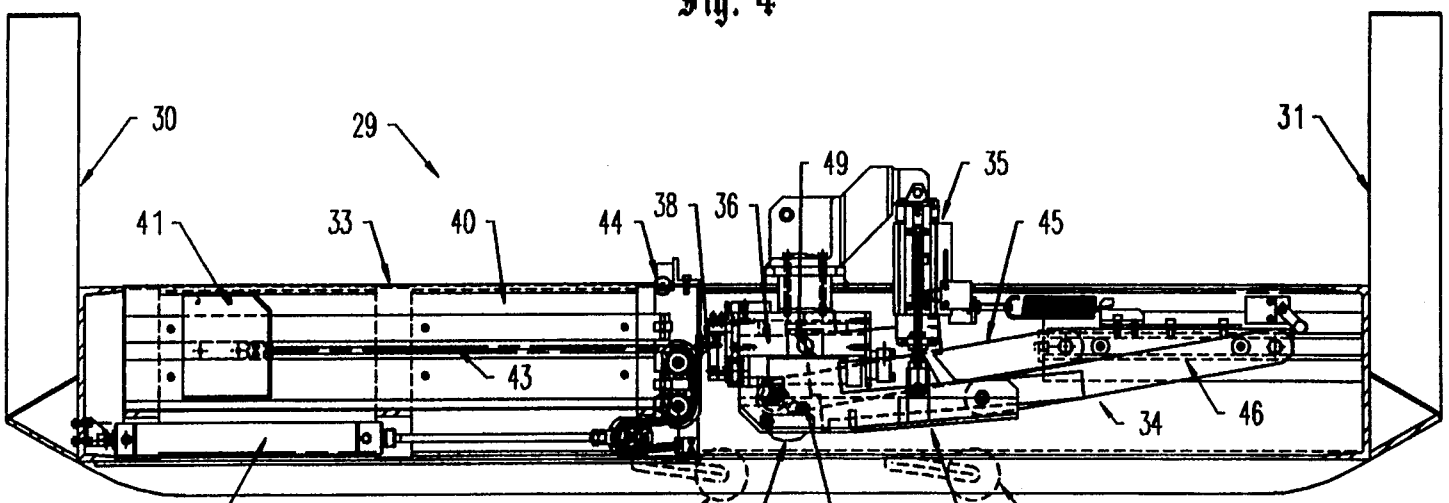
FIG. 5 is a fragmentary longitudinal vertical section view thereof, taken generally on line 5—5 of FIG. 4, this view particularly showing the pad storage magazine and the parallelogram-type linkage.

Referring now to FIGS. 4 and 5, the carriage 29 is shown as broadly including a pad storage magazine, generally indicated at 33; a parallelogram-type linkage, generally indicated at 34; lifting means 35 acting between the carriage and linkage 34, rotation means 36 mounted on the linkage; suction means 38 mounted on the end of the rotation means; and a nailer 39.

The pad storage magazine 33 is shown in FIGS. 4 and 5 at being at the left or forward end of the carriage. The magazine has a U-shaped trough-like pad-receiving receptacle 40, with a follower 41 arranged therein for leftward and rightward longitudinal movement therealong. A pneumatic actuator 42 positioned beneath the magazine, is supplied with air pressure from a suitable source (not shown) through suitable valving (not shown), and is biased to urge its rod to retract. This creates a force which acts through flexible members (i.e., chains) 43 to urge the follower 41 to move rightwardly relative to the carriage toward the parallelogram-type linkage, with 2:1 amplification of motion of the follower relative to the actuator. FIGS. 4 and 5 depict the magazine as being empty, and further illustrate the follower as being displaced leftwardly from its normal position. This is merely for the purpose of illustration. Normally, the pneumatic power supplied to actuator 42 would bias follower 41 to move rightwardly so as to move the supply of pads (not shown in FIGS. 4 and 5) rightwardly toward limit stops 44 adjacent the right end of the pad storage magazine. Thus, the follower is used to bias the pads to move rightwardly within U-shaped magazine.

The parallelogram-type linkage 34 is shown as having legs 45,46. The right marginal end portions of these legs are pivotally mounted on the carriage. The left marginal ends of these legs are pivotally mounted on a skid plate 48. The lifting means 35 is depicted as having a pneumatic actuator arranged with its cylinder portion suitably mounted on the carriage, and having its extensible rod connected to the skid plate. Thus, actuator 35 may be selectively extended or retracted to lower or lift, respectively, the skid plate 48 relative to the carriage.

The rotation means 36 is shown as being mounted on the carriage. The rotation means includes a fluid motor for selectively rotating the suction means about an axis 49. The suction means carries a fluid-powered actuator 47 by which the suction means may be selectively extended or retracted relative to axis 49. The suction means is, of course, connected to suitable means (not shown) for providing a vacuum within the end of suction cups arranged at the distal ends of the actuator rod. An automatic nailer is mounted on the skid plate for movement therewith. This nailer is arranged to be operated when the skid plate contacts the freshly-milled surface of a tie, as sensed by tie-surface contact switch 50 which extends downwardly beneath the skid plate. As best shown in FIGS. 5-10, a pair of tie-sensing limit switches 51,52, respectively, extend downwardly beneath the carriage. These switches have pivotally-mounted followers which are arranged to be pivotally displaced by an encountered tie. Thus, these switches sense the position of a tie relative to the horizontally-moving vehicle and carriage.

OPERATION SEQUENCE (FIGS. 6-10)

Initially, it should be remembered that the vehicle will normally be traveling along a section of track at a constant relative horizontal velocity. Thus, in FIGS. 6-10, the tie is shown in various illustrative positions relative to the carriage in order to graphically depict such relative movement.

Figure 6:
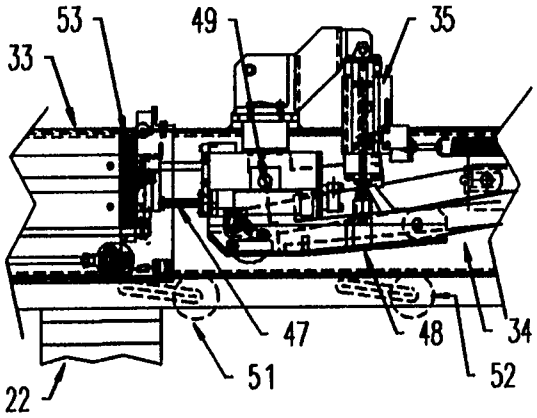
FIG. 6 is a view showing the parallelogram-type linkage as having been raised, and showing the actuator as having been extended so that the suction pad creates a vacuum bond with the end pad in the magazine.

FIG. 6 depicts the salient operational features at the beginning of a cycle with the carriage moving to the left relative to the ties. In this initial position, the lifting means 35 has been retracted to elevate skid plate 48 and the various elements carried thereby. In FIG. 6, suction cup extend/retract actuator 47 is shown as having been extended so as to cause the suction cups to press against the end pad of a plurality of pads 53 in the magazine. Thereafter, a vacuum is drawn in each suction cup, thereby creating a vacuum bond between the suction cup and the end pad.

Figure 7:
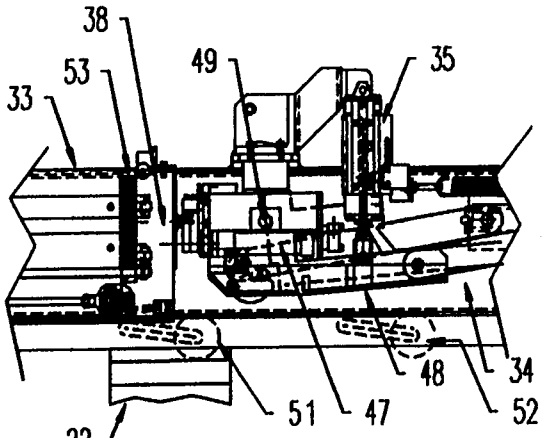
FIG. 7 is a view generally similar to FIG. 6, but shows the pad actuator as having been retracted to withdraw the end pad from the magazine.

Actuators 47 are then retracted, as shown in FIG. 7, to withdraw the end pad from the stack of pads in the magazine.

Figure 8:
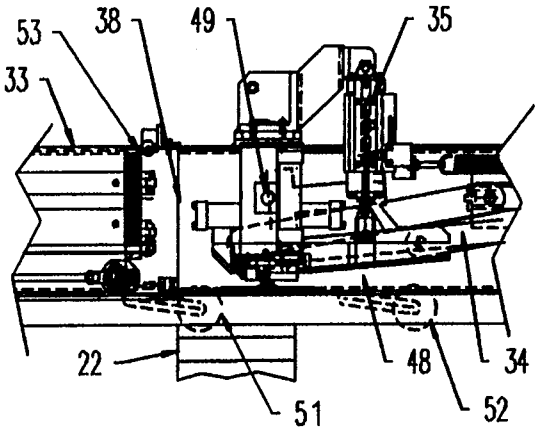
FIG. 8 is a view generally similar to FIG. 7, but shows the withdrawn pad as having been rotated counterclockwise through an angle of approximately 90° so that the withdrawn pad is now positioned overhead an approaching freshly-milled tie surface.

Thereafter, as shown in FIG. 8, the rotary motor is operated to rotate the withdrawn pad through a counterclockwise angle of approximately 90°, so that the withdrawn pad is generally in a raised horizontal position, awaiting the arrival of a tie to which the pad is to be applied.

Figure 9:
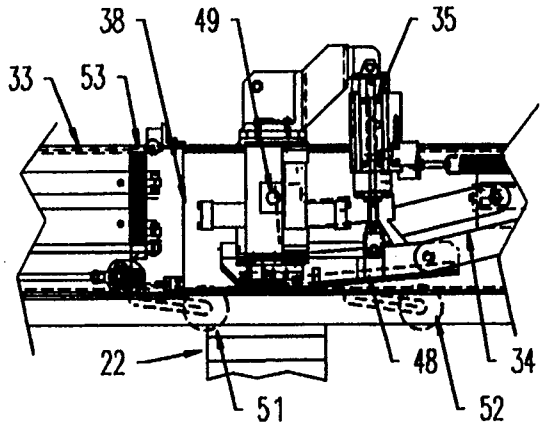
FIG. 9 shows the parallelogram-type linkage as having been lowered to move the pad downwardly toward a tie.

When the presence of a tie is sensed by switch 51 (or by switch 52 for carriage motion to the right), lifting actuator 35 is extended to selectively lower the skid plate toward the tie, as shown in FIG. 9. This lowering motion is accommodated by exercising motion of parallelogram-type linkage 34.

Figure 10:
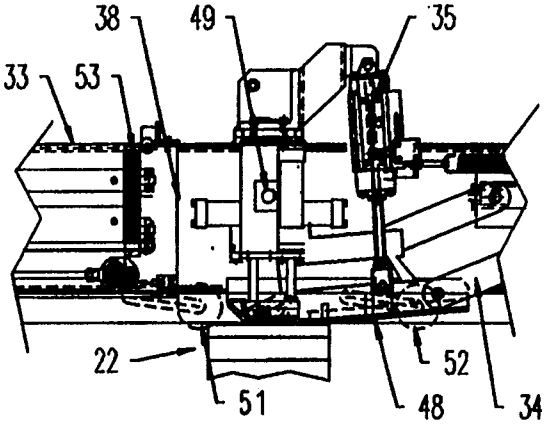
FIG. 10 is a view generally similar to FIG. 9, but shows the parallelogram-type linkage as having been fully lowered to engage the tie, and as having stapled the pad to the tie.

When the skid plate encounters the tie, as shown in FIG. 10, surface sensor 50 sends an appropriate signal to the nailer, which fires the staple guns, injects air into the vacuum system, and retracts lifting cylinder 35 to lift the skid plate from the tie.

Thereafter, the suction cups are returned to the horizontal position, actuator 47 is extended, the next pad is withdrawn from the magazine, and the withdrawn pad is rotated to the "ready" position shown in FIG. 8 to await the arrival of the next sequential tie.

Therefore, the invention broadly provides a mechanism for automatically placing chemically-impregnated pads from a moving vehicle to individual ties passing therebeneath. In other words, the pads are applied "on the fly" from the moving vehicle.

MODIFICATIONS

The present invention contemplates that many changes and modifications may be made. For example, while the disclosed form is shown as being the presently-preferred means for guiding the vehicle along a section of track, it should clearly be understood that other types of vehicle might be used therefor. The present arrangement has the advantage of having the vehicle guided by one rail, while the other is removed. However, in other applications, it might be desirable to steer the vehicle wholly independently of the rail(s). To this end, the vehicle might alternatively have four crawlers. The device may also be operated in either direction.

In any event, the vehicle functions largely as a platform from which to translate and move the carriage along the track section. The carriage itself carries with it the pad storage magazine, the lifting means, the rotational means, the suction means, and so forth. In other embodiments, different forms of devices may be substituted for those shown. For example, the pad storage magazine may assume other forms. Similarly, the lifting means, which is shown as being a simple pneumatic actuator, may be hydraulically or electrically driven as well. The rotational means, which is again shown as being a rotatory pneumatic motor, may be otherwise formed as well. The invention is not limited to use with a staple gun, and other types of nailers might be substituted therefor. The pads themselves are envisioned as being relatively thin rectangular pads of a paper-like material, suitably impregnated with the necessary chemicals. The particular composition of these chemicals is considered to be beyond the scope of the present invention. Similarly, other types and forms of rotational means, lifting cylinders, staplers, suction means, and the like may be readily be substituted therefor.

Therefore, while the presently preferred form of the improved apparatus has been shown and described, and several modifications thereof discussed, persons skilled in this art will readily appreciate that various additional changes and modifications may be made, without departing from the spirit of the invention, as defined and differentiated by the following claims.

What is claimed is:

1. An applicator adapted to apply chemically-impregnated pads to freshly-milled surfaces on railroad ties, comprising:

a vehicle adapted to be moved horizontally along said ties at a relative velocity;

a carriage mounted for horizontal movement with said vehicle along said ties, and mounted for vertical movement relative to said vehicle;

sensing means for sensing the position of each tie passing beneath said carriage;

a pad storage magazine mounted on said carriage;

pad handling means for withdrawing an end pad from said magazine;

positioning means for moving a withdrawn pad from said magazine to a freshly-milled surface on a sensed tie beneath said carriage, said positioning means including rotation means for rotationally moving such withdrawn pad from said magazine to a position above said sensed tie and non-magnetic means for grasping such withdrawn pad during rotation.

2. An applicator as set forth in claim 1 wherein said positioning means includes lowering means for selectively moving said pad downwardly to engage the freshly-milled surface of a sensed tie there beneath.

3. An applicator as set forth in claim 2 wherein said lowering means includes a parallelogram-type linkage mounted on said carriage.

4. An applicator as set forth in claim 1 also comprising nailing means for attaching said withdrawn pad to said sensed tie.

5. An applicator as set forth in claim 4 wherein said nailing means is a staple gun.

6. An applicator as set forth in claim 1 wherein said pad storage magazine includes biasing means for moving said pads toward a predetermined position comprising a follower, a pneumatic cylinder, and flexible means for connecting said cylinder to said follower.

7. An applicator as set forth in claim 1 wherein said pad handling means includes suction means for withdrawing said end pad from said magazine.

8. The method of applying chemically-impregnated pads to freshly-milled surfaces railroad ties, comprising the steps of:

providing a vehicle capable of horizontal movement relative to said ties;

providing a carriage for horizontal movement with said vehicle and for upward and downward movement relative thereto, said carriage having a magazine for said pads;

sensing the position of each tie passing beneath said carriage;

moving said vehicle horizontally along said ties at a relative velocity;

withdrawing an end pad from said pad storage magazine;

providing non-magnetic means for grasping an end pad removed from said pad storage magazine;

grasping said removed end pad by said non-magnetic grasping means;

moving such grasped pad by rotation to a position aligned with the freshly-milled surface on a tie passing there beneath;

lowering said pad to engage said surface.

9. The method as set forth in claim 8 and further comprising the additional step of nailing said pad to said tie.

10. The method as set forth in claim 9 wherein a skid pad is mounted on said carriage for upward and downward movement relative thereto, and further comprising the additional step of raising said skid pad relative to said carriage after said pad has been nailed to said tie.

11. An applicator adapted to apply chemically- impregnated pads to freshly-milled surfaces on railroad ties, comprising:

a vehicle adapted to be moved horizontally along said ties at a relative velocity;

a carriage mounted for horizontal movement with said vehicle along said ties, and mounted for vertical movement relative to said vehicle;

sensing means for sensing the position of each tie passing beneath said carriage;

a pad storage magazine mounted on said carriage;

pad handling means including suction means for withdrawing an end pad from said magazine;

positioning means for moving a withdrawn pad from said magazine to a freshly-milled surface on a sensed tie beneath said carriage.

12. An applicator as set forth in claim 11 wherein said positioning means includes a lowering means for selectively moving said pad downwardly to engage the freshly-milled surface of the sensed tie there beneath.

13. An applicator as set forth in claim 11 also comprising nailing means for attaching said withdrawn pad to said sensed tie.

14. An applicator as set forth in claim 11 wherein said pad storage magazine includes biasing means for moving said pads toward a predetermined position comprising a follower, a pneumatic cylinder, and flexible means for connecting said cylinder to said follower.

15. The method of applying chemically-impregnated pads to freshly-milled surfaces on railroad ties, comprising the steps of:

providing a vehicle capable of horizontal movement relative to said ties;

providing a carriage for horizontal movement with said vehicle and for upward and downward movement relative thereto, said carriage having a magazine for said pads;

sensing the position of each tie passing beneath said carriage;

moving said vehicle horizontally along said ties at a relative velocity;

providing a suction device;

withdrawing an end pad from said pad storage magazine using said suction device;

moving such withdrawn pad to a position aligned with the freshly-milled surface on a tie passing there beneath;

lowering said pad to engage said surface.

16. The method as set forth in claim 15 and further comprising the additional step of nailing said pad to said tie.

17. The method as set forth in claim 15 wherein the step of withdrawing said pad includes the steps of:

extending a resilient cup to engage said end pad;

create a vacuum in said resilient cup to join said cup to said end pad;

retracting said cup with the end pad attached.

18. The method as set forth in claim 16 wherein a skid pad is mounted on said carriage for upward and downward movement relative thereto, and further comprising the additional step of raising said skid pad relative to said carriage after said pad has been nailed to said tie.

* * * * *